US008302653B2

(12) United States Patent
O'Hair

(10) Patent No.: US 8,302,653 B2
(45) Date of Patent: Nov. 6, 2012

(54) VENETIAN BLIND SYSTEM

(75) Inventor: Trey Brant O'Hair, Lubbock, TX (US)

(73) Assignee: Basileia Investments, Inc., Lubbock, TX (US)

( * ) Notice: Subject to any disclaimer, the term of this patent is extended or adjusted under 35 U.S.C. 154(b) by 73 days.

(21) Appl. No.: 12/912,362

(22) Filed: Oct. 26, 2010

(65) Prior Publication Data

US 2012/0097343 A1 Apr. 26, 2012

(51) Int. Cl.
*E06B 9/30* (2006.01)

(52) U.S. Cl. ..... 160/172 R; 160/115

(58) Field of Classification Search ..... 160/172 R, 160/168.1 R, 115, 107, 34, 178.1 R, 173 R, 160/176.1 R; 49/86.1
See application file for complete search history.

(56) References Cited

U.S. PATENT DOCUMENTS

| | | | | |
|---|---|---|---|---|
| 1,327,363 | A | 1/1920 | Wilson et al. | |
| 1,708,636 | A | 4/1929 | Shook | |
| 1,889,226 | A | 11/1932 | Steffen | |
| 2,003,174 | A | 5/1935 | Cooper | |
| 2,031,354 | A | 2/1936 | Wright | |
| 2,117,953 | A * | 5/1938 | Grau | 160/114 |
| 2,139,781 | A * | 12/1938 | Trammell | 160/172 R |
| 2,165,292 | A * | 7/1939 | Morse et al. | 160/173 R |
| 2,207,605 | A * | 7/1940 | Wolfe | 160/176.1 R |
| 2,237,850 | A | 4/1941 | Stobie | |
| 2,256,369 | A | 9/1941 | Ziegler | |
| 2,365,248 | A | 12/1944 | Christiani | |
| 2,685,922 | A | 8/1954 | Bennett | |
| 2,787,322 | A * | 4/1957 | Jacobson et al. | 248/251 |
| 3,389,737 | A * | 6/1968 | Arnold et al. | 160/107 |
| 3,722,572 | A * | 3/1973 | Hall | 160/107 |
| 3,744,544 | A | 7/1973 | Wellensiek | |
| 4,199,019 | A | 4/1980 | Frei | |
| 4,245,435 | A * | 1/1981 | Ulbricht | 49/64 |
| 4,424,852 | A | 1/1984 | Hopper | |
| 4,685,502 | A * | 8/1987 | Spangenberg | 160/107 |
| 4,723,586 | A * | 2/1988 | Spangenberg | 160/107 |
| 4,865,109 | A | 9/1989 | Sherman | |
| 4,951,729 | A * | 8/1990 | Chi Yu | 160/178.3 |
| 5,086,823 | A * | 2/1992 | Danchulis et al. | 160/236 |
| 5,143,135 | A | 9/1992 | Kuhar | |
| 5,348,068 | A * | 9/1994 | Elsenheimer et al. | 160/176.1 R |

(Continued)

FOREIGN PATENT DOCUMENTS

AU B-24636/97 1/1998

(Continued)

*Primary Examiner* — David Purol
(74) *Attorney, Agent, or Firm* — Oliff & Berridge, PLC

(57) ABSTRACT

A blind system has a horizontally positioned tilt rail having a longitudinal axis and a plurality of slats suspended from the tilt rail via at least one connecting member. The tilt rail includes a reinforcing member and a tensioning member. The blind system also has a divided slat that is divided lengthwise into a first sub-slat and a second sub-slat and has a longitudinal axis with each of the first and second sub-slats configured to be movable with respect to each other so that when each of the plurality of slats are in an angular position with respect to the corresponding slat longitudinal axis that restricts at least a portion of light passing between the slats, either the first sub-slat or the second sub-slat has an angular position with respect to the divided slat longitudinal axis that is substantially the same as the angular position of each slat depending on a direction of rotation of the plurality of slats.

32 Claims, 13 Drawing Sheets

U.S. PATENT DOCUMENTS

| | | | | |
|---|---|---|---|---|
| 5,839,492 | A * | 11/1998 | Young | 160/107 |
| 6,266,923 | B1 | 7/2001 | Lee | |
| 6,602,014 | B2 | 8/2003 | Lee | |
| 6,688,372 | B1 | 2/2004 | Nien | |
| 6,705,379 | B1 | 3/2004 | Nien | |
| 6,880,607 | B2 * | 4/2005 | Marocco | 160/173 R |
| 7,124,804 | B2 | 10/2006 | Hsu | |
| 7,174,942 | B2 | 2/2007 | Hsu | |
| 2007/0175598 | A1 | 8/2007 | Hung | |
| 2007/0187048 | A1 | 8/2007 | Hung | |
| 2007/0193702 | A1 | 8/2007 | Hung | |
| 2008/0099160 | A1 | 5/2008 | Chen | |

FOREIGN PATENT DOCUMENTS

| | | |
|---|---|---|
| DE | 299 13 131 | 12/2000 |

* cited by examiner

VENETIAN BLIND SYSTEM

BACKGROUND

A venetian blind system is a popular window treatment that includes a plurality of horizontal slats designed to overlap when in a tilted closed position. Conventional venetian blinds suspend the horizontal slats as a group either from ladder drums or from a tilt-rail, via one or more ladder tapes or string ladders. The amount of light passing though the venetian blind system is regulated by raising, lowering and tilting the slats. The slats are raised and lowered by actuating a lift control such as a cord that either gathers or extends the ladder tapes by lifting a foot-rail. A tilt control such as, for example, a wand is used to rotate the ladder-drums or tilt-rail, which in turn causes the horizontal slats to rotate. Ladder drums are typically enclosed by a head-box secured to the top of the window opening. The tilt-rail is typically supported by a base-rail secured to the top of the window opening. In addition, the head box acts as a housing for other mechanical elements that facilitate the lifting and rotating of the slats and the base-rail acts as a mounting base for similar mechanical elements.

Conventional venetian blind systems are limited in the profile width of the slats. The slats of conventional venetian blinds are typically positioned within the window frame so that the window frame can provide privacy when the slats are in a tilted-closed position. Because the depths of many window frames are small and provide for a limited clearance distance between the slats and the window, wider profile slats must project out front of the window opening. As a result, when in the tilted-closed position, there is a lack of privacy at the sides of the window opening. Head-box systems also limit the profile width of the slats because of maximum mechanical tilt capacity. Wider tilt capacity results in higher cost.

In addition, the current design of conventional tilt rail systems increase the costs and complexity of wide span venetian blinds. In particular, conventional tilt-rails have relatively flat and elongated shapes that are susceptible to sagging. Such sagging can adversely affect the tilting function of the slats. To counter the undesired sag, conventional tilt-rails require additional supports that contribute to the costs and complexity of the venetian blind system.

SUMMARY

To solve the above-discussed limitations of conventional venetian blind systems, a venetian blind system is provided having several modifications designed to permit large profile width slats and reduce the costs and complexity of wide span venetian blinds.

A first possible modification includes a tilt rail assembly having a base member in the shape of a venetian blind slat and having a first end, and a second end. The tilt rail assembly may also include a pair of support members with each support member configured to vertically and horizontally support the base member at one of the first and second ends. In addition, the tilt rail assembly may include a reinforcing member extending along a length of the base member and having a first end and a second end, the reinforcing member being configured to restrict or prevent sagging of the base member.

The tilt rail assembly may also include a tensioning member extending between the first and second ends of the reinforcing member. The tensioning member may be configured to apply a tensioning force along the reinforcing member that further restricts or prevents sagging of the reinforcing member and base member.

The reinforcing member and the tensioning member reduce the amount of sag experienced by tilt rails that span large distances by increasing the stiffness of the tilt rail. As previously discussed, conventional blind systems utilize tilt rail supports to reduce sagging of the tilt rail, by providing a vertical support between the ends of the tilt rail. Thus, the reinforcing member and the tensioning member reduce the number of tilt rail supports needed, or eliminate the use of tilt rail supports all together. The reduction or elimination of tilt rail supports adds to the aesthetic value of the overall venetian blind system, and simplifies the construction and installation of venetian blind systems. In addition, utilizing the reinforcing and tensioning members improves the tilt rail performance while reducing the costs and complexity of the blind system. For example, because conventional tilt rail supports are fixedly anchored to an associated window frame via a base rail, each tilt rail support could potentially resist the rotational movement of the tilt rail, thereby interfering with the performance of the tilt rail. In addition, each additional tilt rail support increases the number of components comprising the blind system. Therefore, reducing the number of tilt rail supports would reduce the costs and complexity of large span venetian blinds.

The reinforcing member and the tensioning member may also increase the variety of materials from which the tilt rail may be constructed. In particular, because the reinforcing member and the tensioning member may strengthen the tilt rail, weaker materials that may be prone to sagging such as, for example, plastic materials, may be used in large span venetian blind systems.

A second possible modification includes a venetian blind including a plurality of slats having a slat width and a divided slat assembly. The divided slat assembly may include a first and second sub-slat, each sub-slat having a width that is approximately half the slat width. The first and second sub-slats may be pivotably connected to each other along a length of the first and second sub-slats. In addition, the slats and the divided slat assembly may be configured such that when the slats tilt from a horizontal position towards a first direction, the first sub-slat tilts with the slats while the second sub-slat remains in the horizontal position, and when the slats tilt from the horizontal position in a direction opposite to the first direction, the first sub-slat remains in the horizontal position while the second sub-slat tilts with the slats.

The second modification may also include a lift rail positioned below the divided slat. The first and second sub-slats may be configured so that when each of the plurality of slats are in a particular angular position which restricts at least a portion of light passing between the slats, one of either the first or second sub-slat is in substantially the same angular position as of each of the plurality of slats, while the other of the first and second sub-slats lays flat on an upper surface of the lift rail.

Another possible modification may also include first and second side frames configured such that a recessed portion extends along the length of each of the associated side frames. The recessed portions may be designed to receive projections that may be formed at opposite ends of each of the plurality of slats. In addition, one of the side frames may include components of a tilting system that may cause the tilt rail and the slats to tilt. The other side rail may include components of a lift system that may cause the slats to move up and down.

Locating the components of the lift and tilt systems in the side frames eliminates the need for a head box because the function of the conventional head box is performed by the side frames. In addition, utilization of the side frames may permit the utilization of large-width slats. In particular, portions of the side frames may be used to restrict the undesired movement of the slats in a side-to-side or back-and-forth direction. Thus, because the venetian blind system does not need to be positioned completely within the window frame, the venetian blind system can be moved at least partially outside of the window frame. Thus, the clearance distance between the window and the slats can be increased, while maintaining privacy at the sides of the window opening and permitting larger widths for the slats.

For conventional venetian blind systems the foot-rail cannot be accurately extended to prevent undesired light from passing between the foot-rail and the sill or bottom of the window frame, when the blind is tilted in a closed position. However, in embodiments including the first and second side frames, a non-tilting lift rail may be employed that can be properly extended to prevent undesired light at the sill or bottom of the window frame.

A third modification includes a modular venetian blind system having a first side frame module, a second side frame module, a tilt-rail module and a slat/lift-rail module. The slat/lift-rail module may include a lift rail, and a set of tiltable slats operatively connected to the lift-rail and that operatively connect to the tilt rail module. At least one of the first and second side frame modules includes a tilt mechanism configured to tilt the tilt rail module and thereby tilt the operatively connected slats. In addition, the first and second side frame modules each include a lift mechanism configured to raise and lower the lift rail and thereby raise and lower the operatively connected slats.

The modular blind system may be secured to the window opening by securing the selected lift and tilt side frame modules to opposing edges of the window opening, securing the selected tilt rail module to the selected lift and tilt side frame modules, and suspending the selected slat/lift-rail module from the selected tilt rail module. In addition, the tilt rail module may include a tilt rail. The slat/lift-rail module may include a plurality of slats. The lift side frame modules may include a lift mechanism that causes the plurality of slats to move up and down. Also, the tilt side frame module may include a tilt mechanism that causes the tilt rail module and the plurality of slats to tilt or rotate.

The tilt side frame module may include at least one interchangeable sub-assembly that includes components of both the lift mechanism and the tilt mechanism. The lift side frame module may include at least one interchangeable sub-assembly that includes components of only the lift mechanism.

Combining the components into a small number of prefabricated modules simplifies the design of the venetian blind system. In addition, simplifying the design of the venetian blind system reduces the costs and improves the durability of the venetian blind system.

Such prefabricated modules also simplify installation of the venetian blind system, thereby reducing installation costs. For example, by utilizing prefabricated modules, the number of steps for installing the venetian blind system can be reduced, thereby reducing the amount of time and labor needed to install the venetian blind system. In addition, utilizing interchangeable sub-assemblies can further reduce the complexity and cost of installation of the venetian blind system by reducing the number of separate components in each module.

BRIEF DESCRIPTION OF THE DRAWINGS

Various exemplary embodiments of this disclosure will be described in detail with reference to the following figures, wherein like numerals reference like elements, and wherein.

DETAILED DESCRIPTION OF EMBODIMENTS

Figure 1:
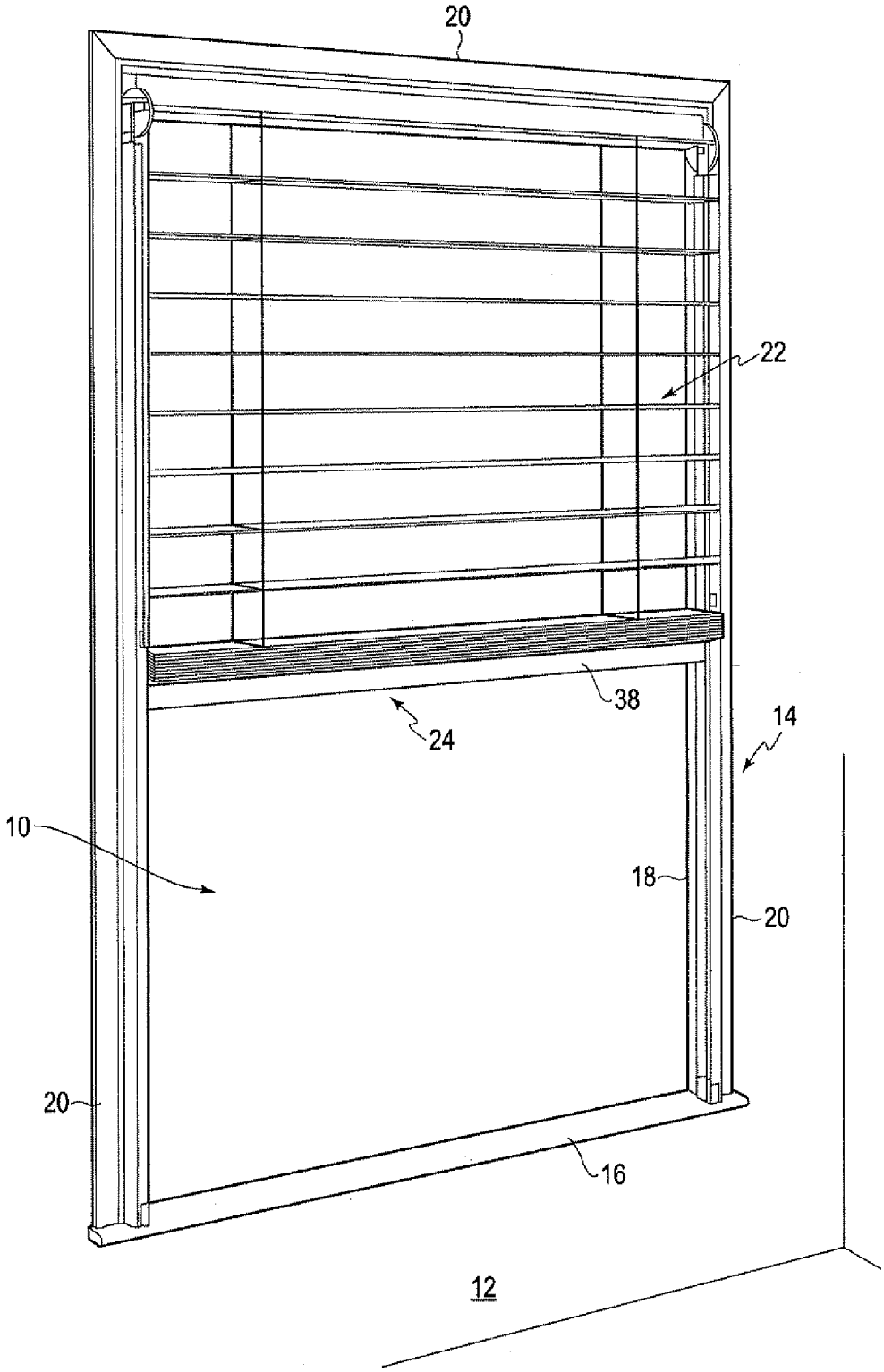
FIG. 1 illustrates an exemplary blind system in a window frame.

FIG. 1 shows a window opening 10 in a wall 12. In addition, a window frame 14 may enclose the window opening 10. The window frame 14 may include a windowsill 16, a plurality of window jambs 18 and a plurality of molding members 20. A blind system 22 may be attached to the window frame 14 so that the blind system 22 overlaps the window opening 10. The blind system 22 may be secured to the window frame 14 via any device or system such as, for example, mechanical fasteners, adhesives, or any other device or system capable of securing the blind system 22 to the window frame 14. Although FIG. 1 shows the blind system 22 being attached to the window frame 14, it is contemplated that the blind system 22 may be installed in window openings 10 that may lack a window frame 14. In such a configuration, the blind system 22 may be attached directly to portions of the wall 12 surrounding the window opening 10. Also, the blind system 22 may project beyond the window frame 14 to accommodate a depth of the blind system 22.

Unlike conventional blind systems that may be secured to a top portion of the window frame 14, the blind system 22 may be secured through two side frame modules to opposing vertical side portions of the window frame 14. Each side frame module may be selected from a plurality of premanufactured side frame modules configured to have different lengths. Such module lengths may substantially match the heights of standard or custom sized windows. A side frame module may be selected from the plurality of side frame modules based on the height of the window frame 14 to which the selected side frame module is to be secured.

A tilt rail module may be secured to both side frame modules. In this configuration, the slat/lift-rail module would be suspended from the tilt rail module and may be moveably connected to both side frame modules. In addition, the tilt rail module may be selected from a plurality of tilt rail modules, while the slat/lift-rail module may be selected from a plurality of slat/lift-rail modules. Similar to the plurality of side frame modules, the plurality of tilt rail modules and slat/lift-rail modules may have different lengths corresponding to the widths of standard or custom sized windows. The tilt rail module and slat/lift-rail module may be selected based on the dimensions of the window (e.g., the selected tilt rail module may be the tilt rail module having a length closest to the width of the window, while the selected slat/lift-rail module may be the slat/lift-rail module having a length and height closest to the width and height of the window).

Because of the load created by the weight of the slat/lift-rail module and the length of the span between the side frame modules, the tilt rail may be prone to sagging. Rather than utilize support members secured to the upper portion of the window frame to prevent sag, the tilt rail found in the tilt rail module may include a reinforcing member and a tensioning member that extends along a longitudinal length of the tilt rail module. The reinforcing member and the tensioning member should be configured so as to increase the stiffness of the tilt rail module and eliminate the need for support members secured to the upper portion of the window frame.

One of the side frame modules may include a tilt mechanism and components of a lift mechanism, while the other side frame module may include only components of the lift mechanism. The tilt mechanism may actuate to cause the tilt rail module to rotate about a longitudinal axis. The rotational movement of the tilt rail may in turn cause a plurality of slats in the slat/lift-rail module to rotate about longitudinal axes of each slat. In addition, the lift mechanism may cause the plurality of slats to move up and down. Some of the components of the lift and tilt mechanisms located in the one side frame module may be combined into a single sub-assembly, while some of the components of the lift mechanism located in the other side frame module may be combined into another sub-assembly.

The plurality of slats may include a divided slat that may be divided along a length of the divided slat and may form a first sub-slat and a second sub-slat. The first and second sub-slats may be configured so that when the plurality of slats are rotated, either the first sub-slat is rotated or the second sub-slat is rotated. In addition, while either the first or second sub-slat is rotated, the other sub-slat remains flat against a lift rail provided below the divided slat.

Figure 2:
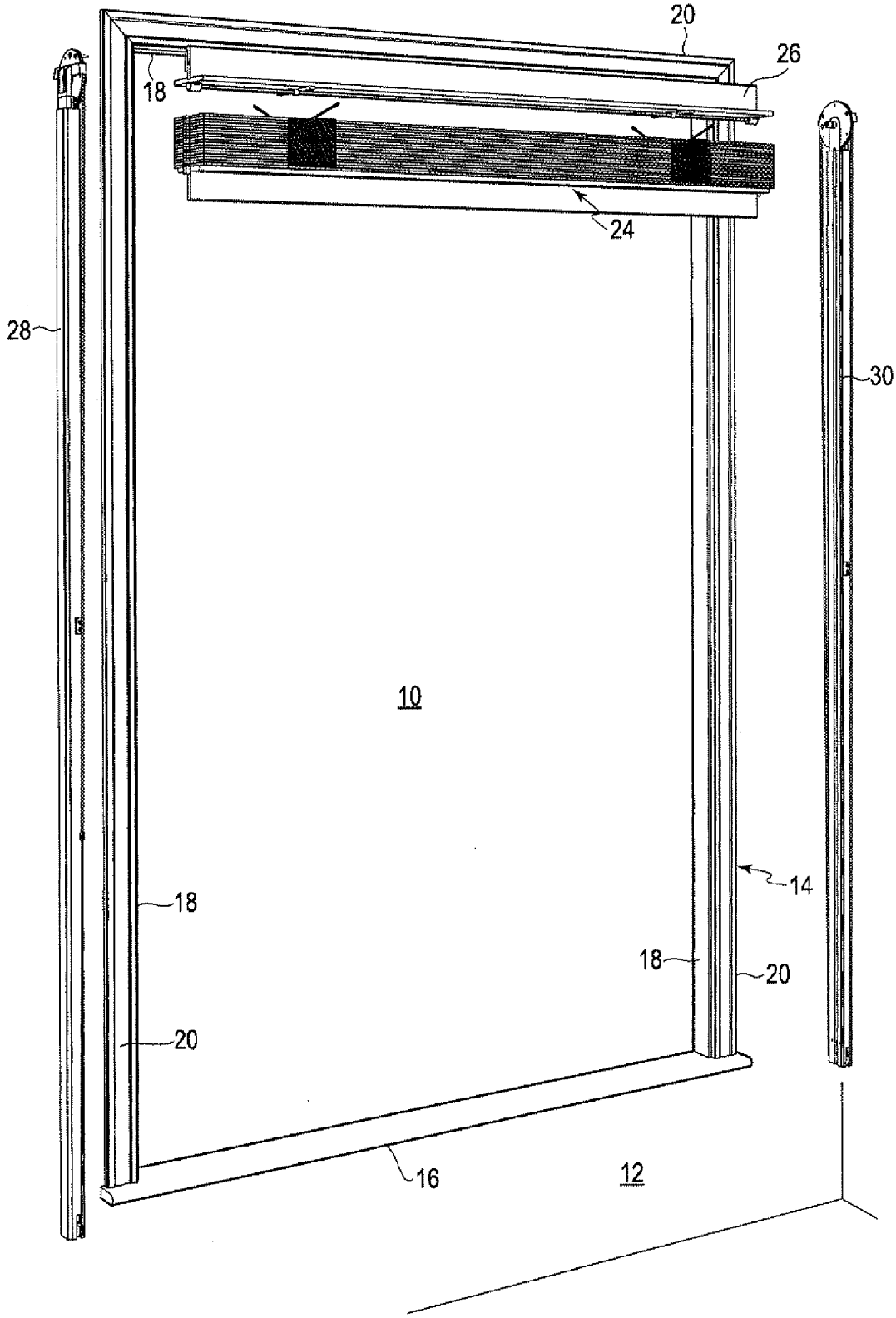
FIG. 2 illustrates exemplary modular components of the blind system of FIG. 1.

As illustrated in FIG. 2, the blind system 22 may be formed from a plurality of modular components (that may be manufactured to dimensions that closely correspond to the dimensions of typical window openings as shown by window opening 10. It is contemplated that the modular components may also be manufactured to dimensions that may closely correspond to the dimensions of common window openings. Such components may include, for example, a slat/lift-rail module 24, a tilt rail module 26, a left side frame module 28 and a right side frame module 30.

Figure 3:
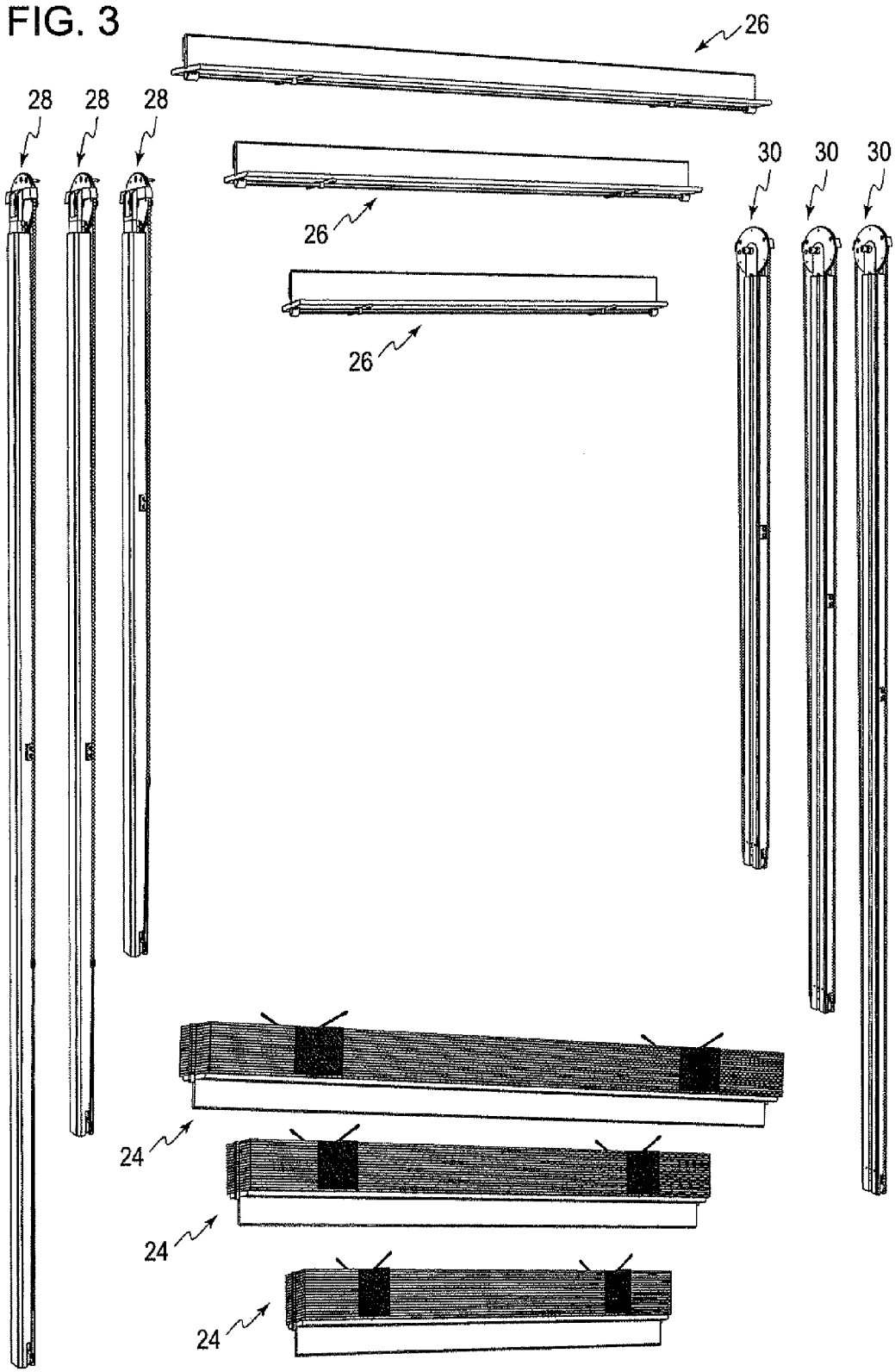
FIG. 3 illustrates a plurality of exemplary modular components having different lengths.

FIG. 3 illustrates multiple slat/lift-rail modules 24, tilt rail modules 26, left side frame modules 28 and right side frame modules 30, with each individual module having a different length. The modules that form the blind system 22 may be selected from the plurality of modules based on the lengths of the modules. For example, the modules having dimensions that are closest to the window opening 10 may be selected from the plurality of modules. In the case of the slat/lift-rail modules 24 and tilt rail modules 26, the modules having lengths closest to a width of the window opening 10 may be selected. In the case of the left and right side frame modules 28 and 30, the modules having lengths closest to a height of the window opening 10 may be selected.

Referring back to FIG. 1, the slat/lift-rail module 24 may include a plurality of rectangular slats 32 positioned above and below each other. Each slat 32 may have any dimension such as for example, four inches or greater width and four feet or greater lengths. In addition, each slat 32 may be connected to other slats 32 above and/or below the slat 32 via a plurality of connecting members 34. Each connecting members 34 may be, for example, a ladder tape, a chain, or any other collapsible device capable of connecting the slats 32 while also facilitating the lifting and lowering of the slats 32. Also, each end of each slat 32 may include a projection 36 that may interact with the left side frame module 28 or the right side frame module 30.

The slat/lift-rail module 24 may also include a lift rail 38 located beneath the plurality of slats 32. The lift rail 38 could be configured to facilitate the lifting of the plurality of slats 32 and may provide support for the plurality of slats 32 as the slats 32 are raised or lowered. For example, in a completely lowered position, the slats 32 may be suspended via the connecting members 34. However, when the lift rail 38 is raised, the lift rail 38 may contact the lowest slat 32 and may lift the lowest slat 32. While being lifted, the lowest slat 32 may cease to be suspended via the connecting member 34 and may be supported by the lift rail 38. As the lift rail 38 continues to move upward, the next lowest slat 32 may come into contact with the lowest slat 32. Such contact may cause the next lowest slat 32 to be supported by the lift rail 38 instead of being suspended via the connecting member 34. This chain of events may continue until the lift rail 38 is at a desired height or until all of the slats 32 are supported by the lift rail 38.

The lift rail 38 may be supported only at each end by the right and left side frame modules 28 and 30. Without supports toward the middle of the lift rail 38, the structure of the lift rail 38 would need to be strong enough to resist sagging while supporting the plurality of slats 32. Accordingly, the lift rail 38 may have, for example, a cross-sectional "T" shape or any other cross-sectional shape that increases a stiffness of the structure of the lift rail 38.

Figure 4:
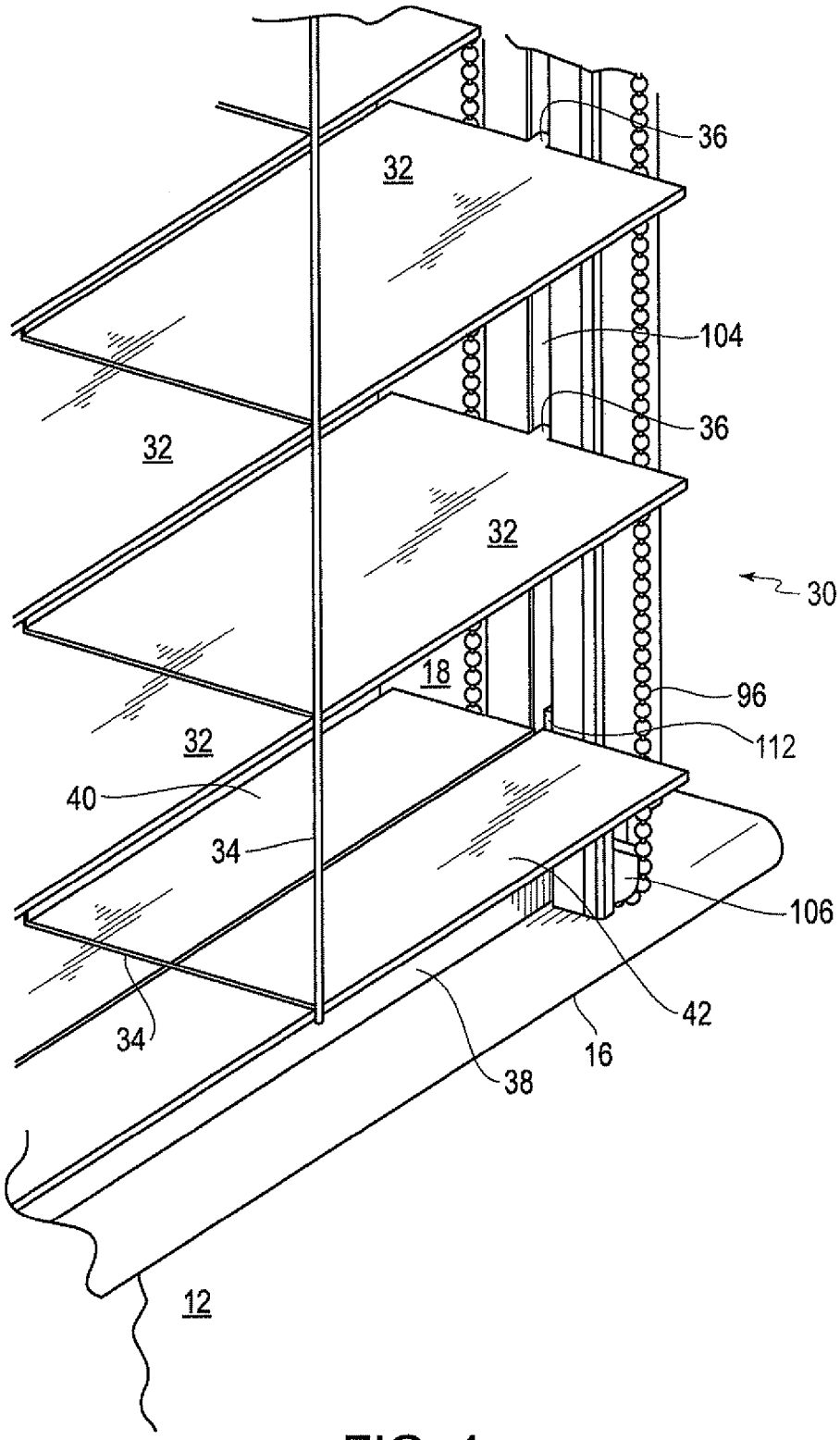
FIG. 4 illustrates details of an exemplary portion of the blind system of FIG. 1.
Figure 5:
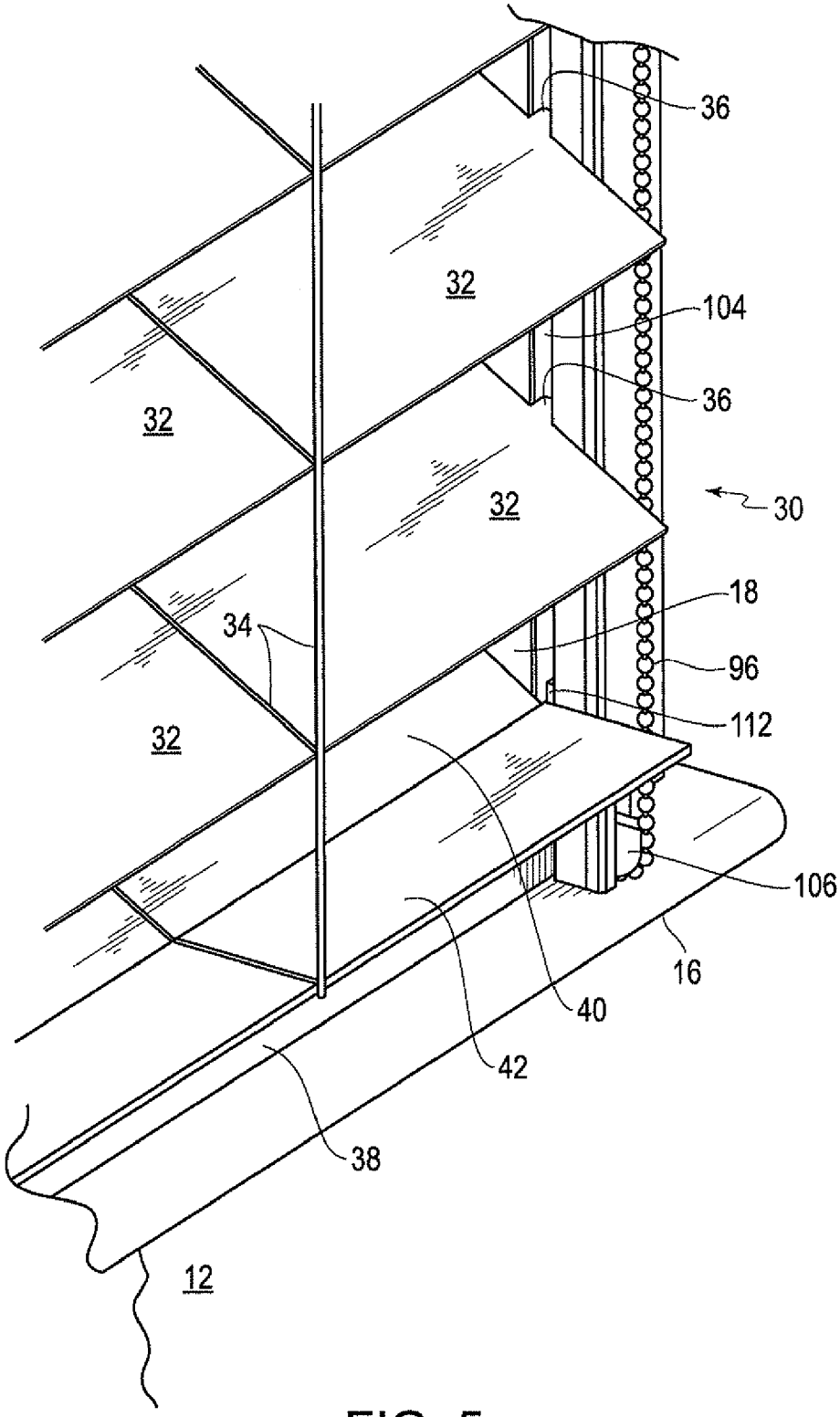
FIG. 5 illustrates details of an exemplary portion of the blind system of FIG. 1 with the slats tilted in a first direction.
Figure 6:
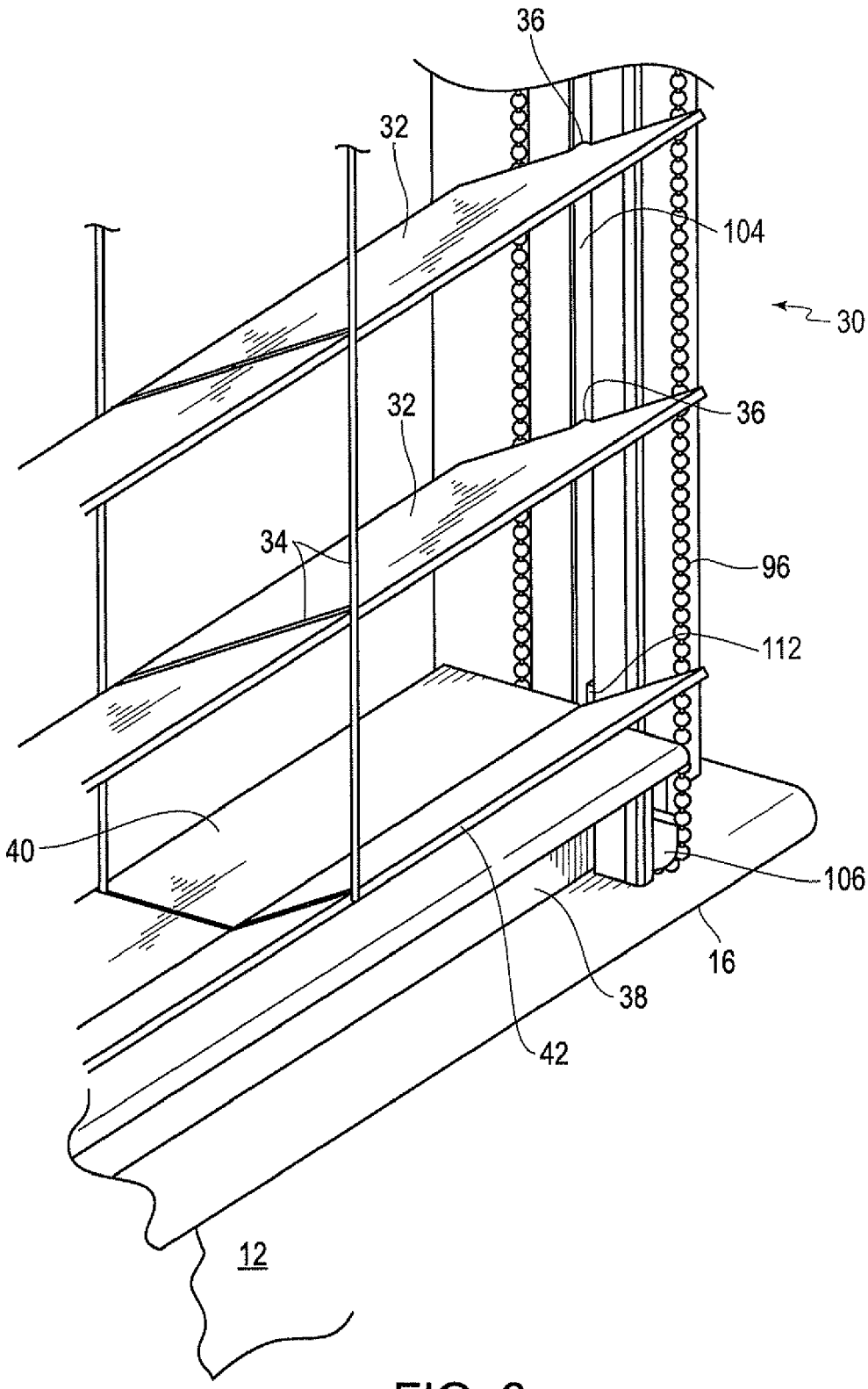
FIG. 6 illustrates details of an exemplary portion of the blind system of FIG. 1 with the slats tilted in a second direction.

As shown in FIGS. 4-6, the bottom slat 32 of the slat/lift-rail module 24 may be formed from two sub-slats 40 and 42. The sub-slats 40 and 42 may be approximately half as wide as the rest of the slats 32. In addition, the sub-slats 40 and 42 may be situated side-by-side beneath the slats 32. When the lift rail 38 is in a completely lowered position, and the slats 32 are not in a tilted position, the sub-slats 40 and 42 may lay flat on a top portion of the lift rail 38. When the slats 32 are tilted in a first direction away from a horizontal position, the sub-slat 40 may tilt in the same direction as the rest of the slats 32, while the sub-slat 42 may remain flat on the top portion of the lift rail 38. When the slats 32 are tilted in a second direction away from the first direction and the horizontal position, the sub-slat 42 may tilt in the same direction as the rest of the slats 32, while the sub-slat 40 may remain flat on the top portion of the lift rail 38.

Figure 7:
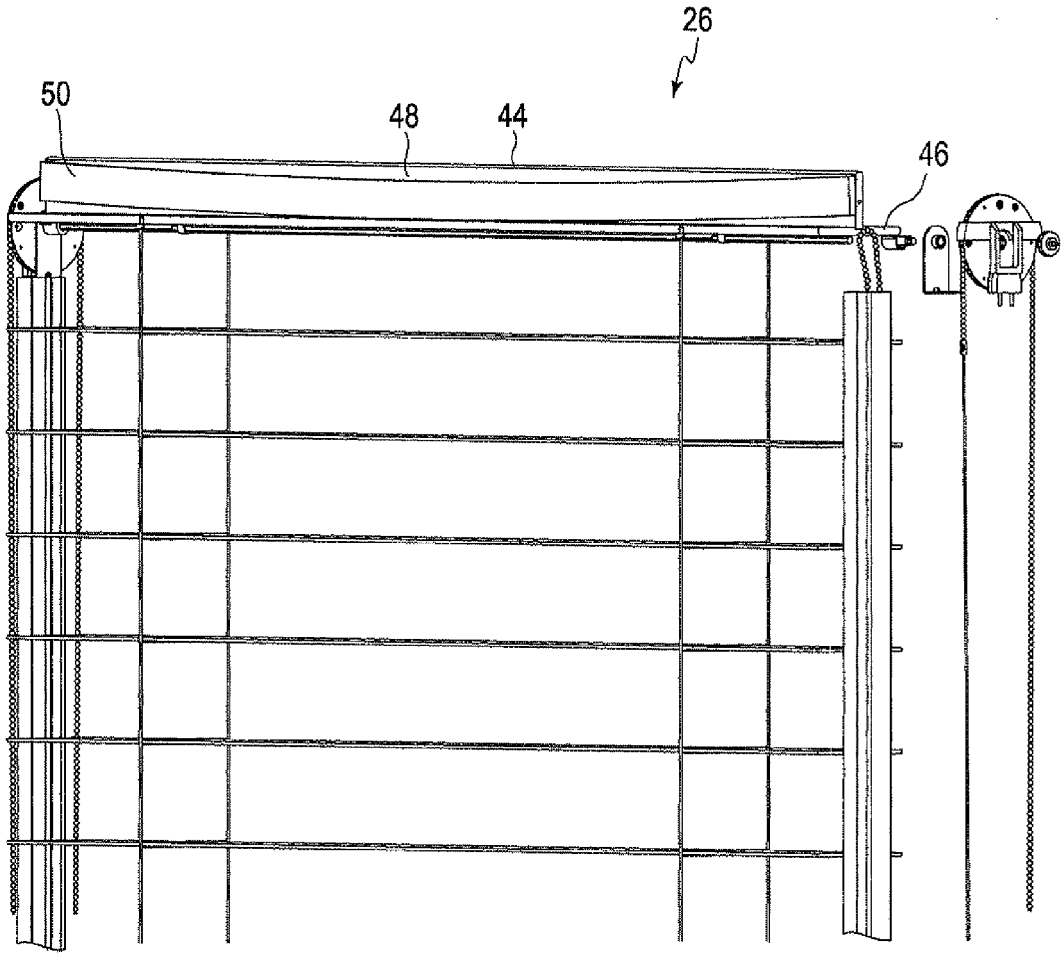
FIG. 7 illustrates details of an exemplary portion of the blind system of FIG. 1.
Figure 8:
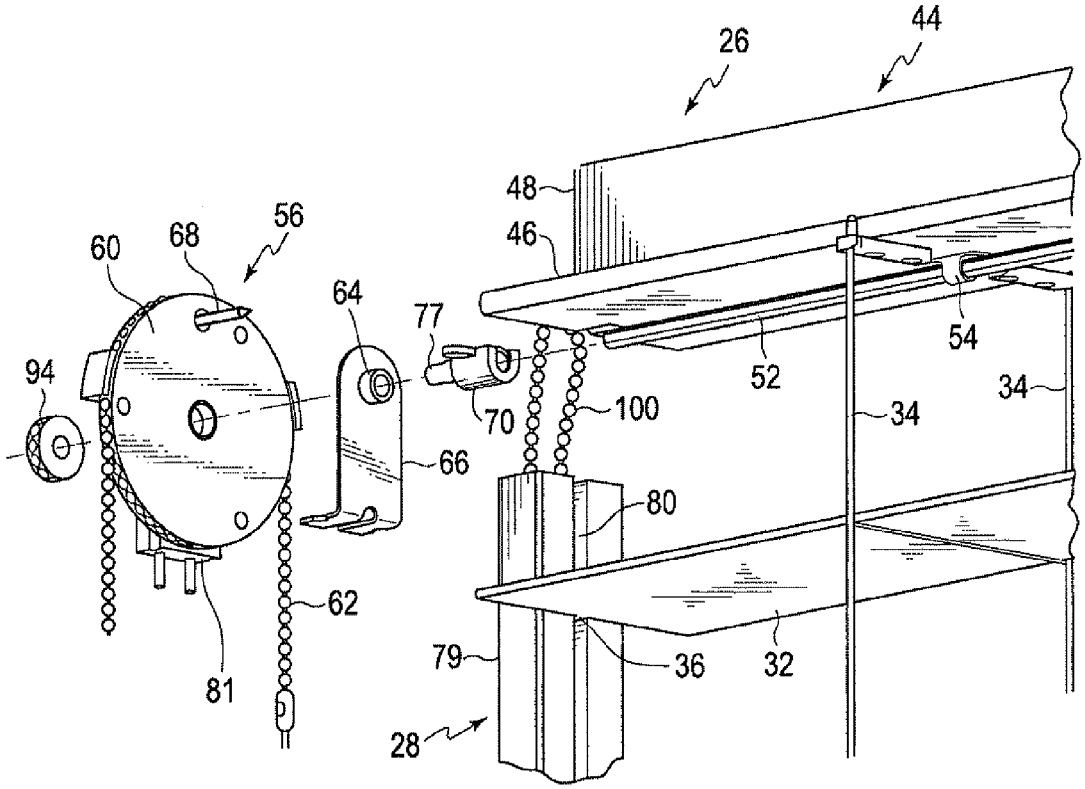
FIG. 8 illustrates an exemplary exploded view of an upper portion of the blind system of FIG. 1.
Figure 9:
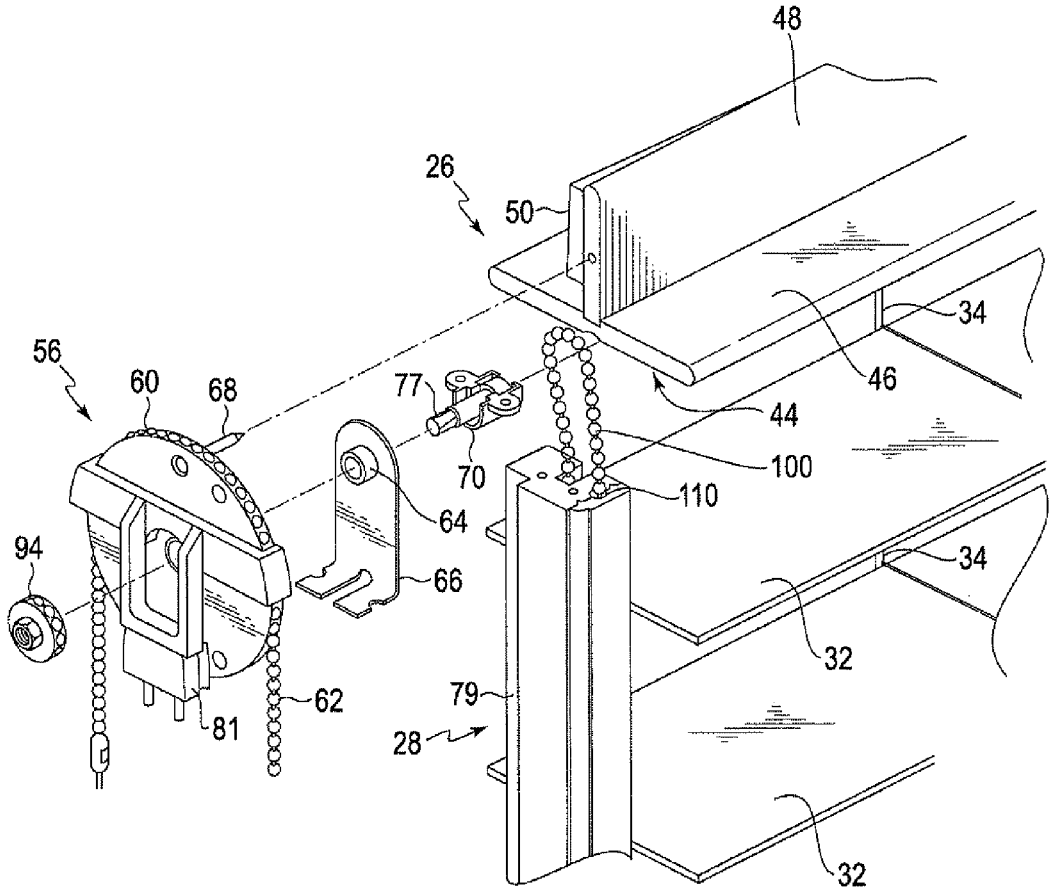
FIG. 9 illustrates another exemplary exploded view of the upper portion of the blind system of FIG. 1.
Figure 10:
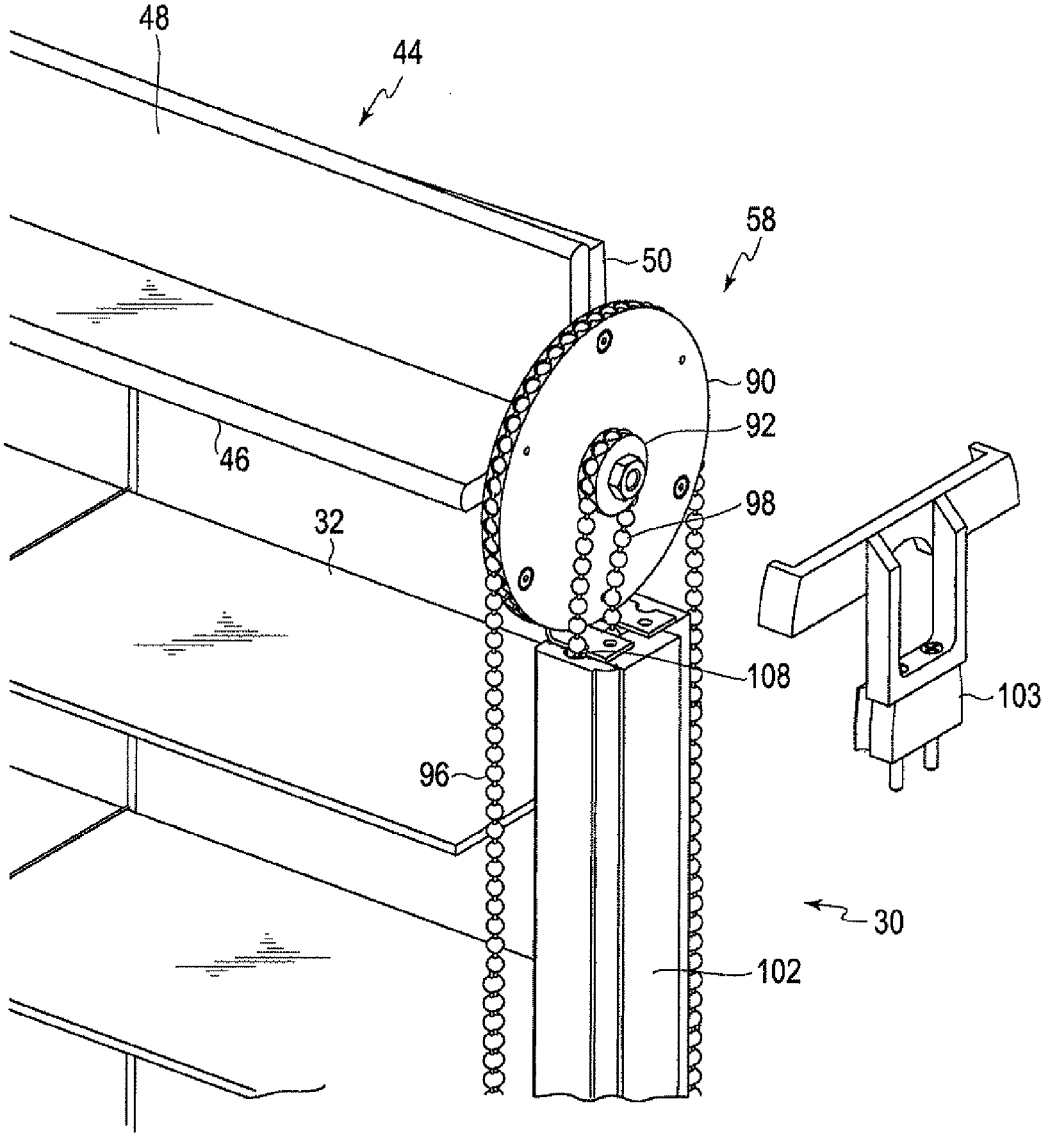
FIG. 10 illustrates another exemplary exploded view of the upper portion of the blind system of FIG. 1.
Figure 11:
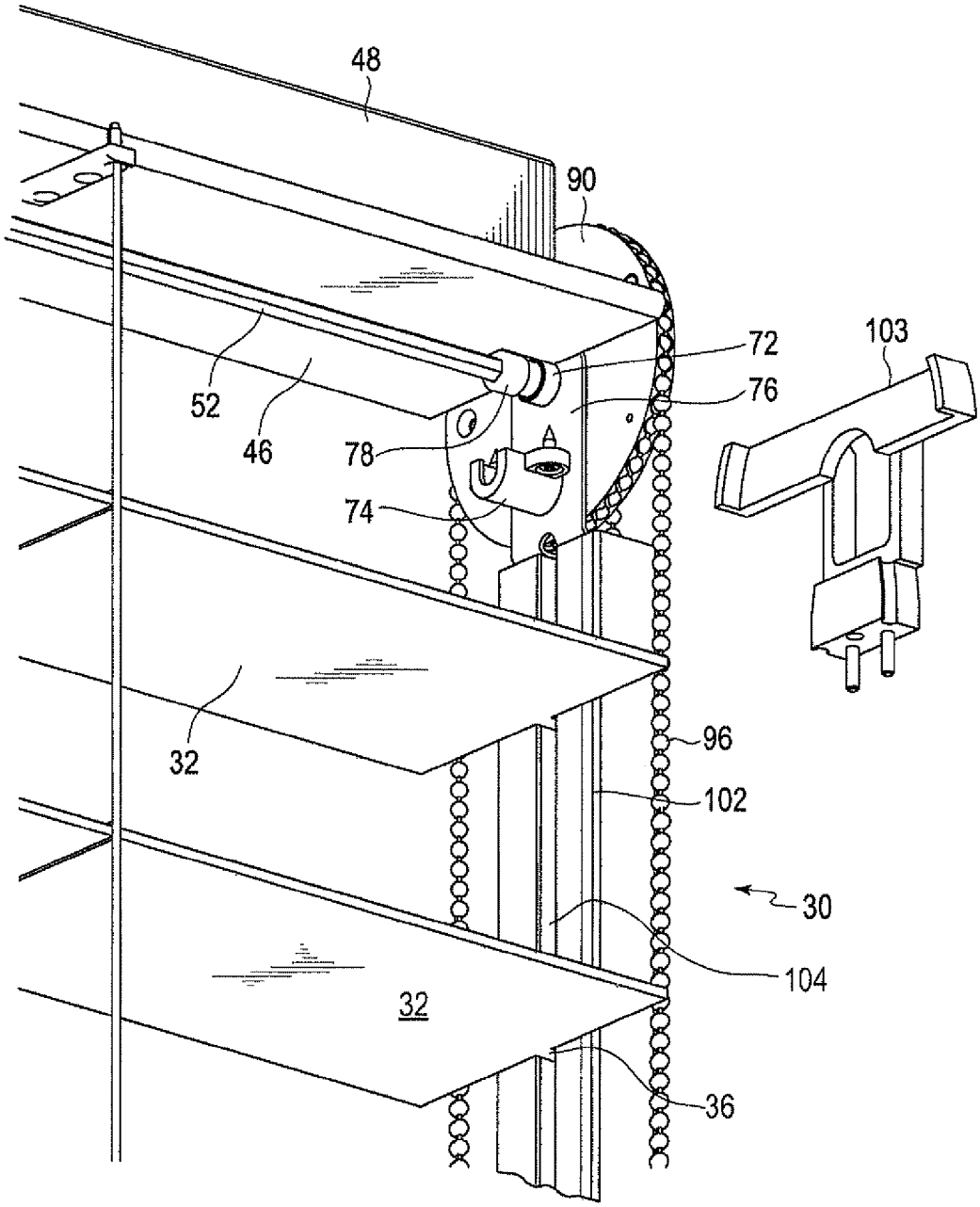
FIG. 11 illustrates another exemplary exploded view of the upper portion of the blind system of FIG. 1.
Figure 12:
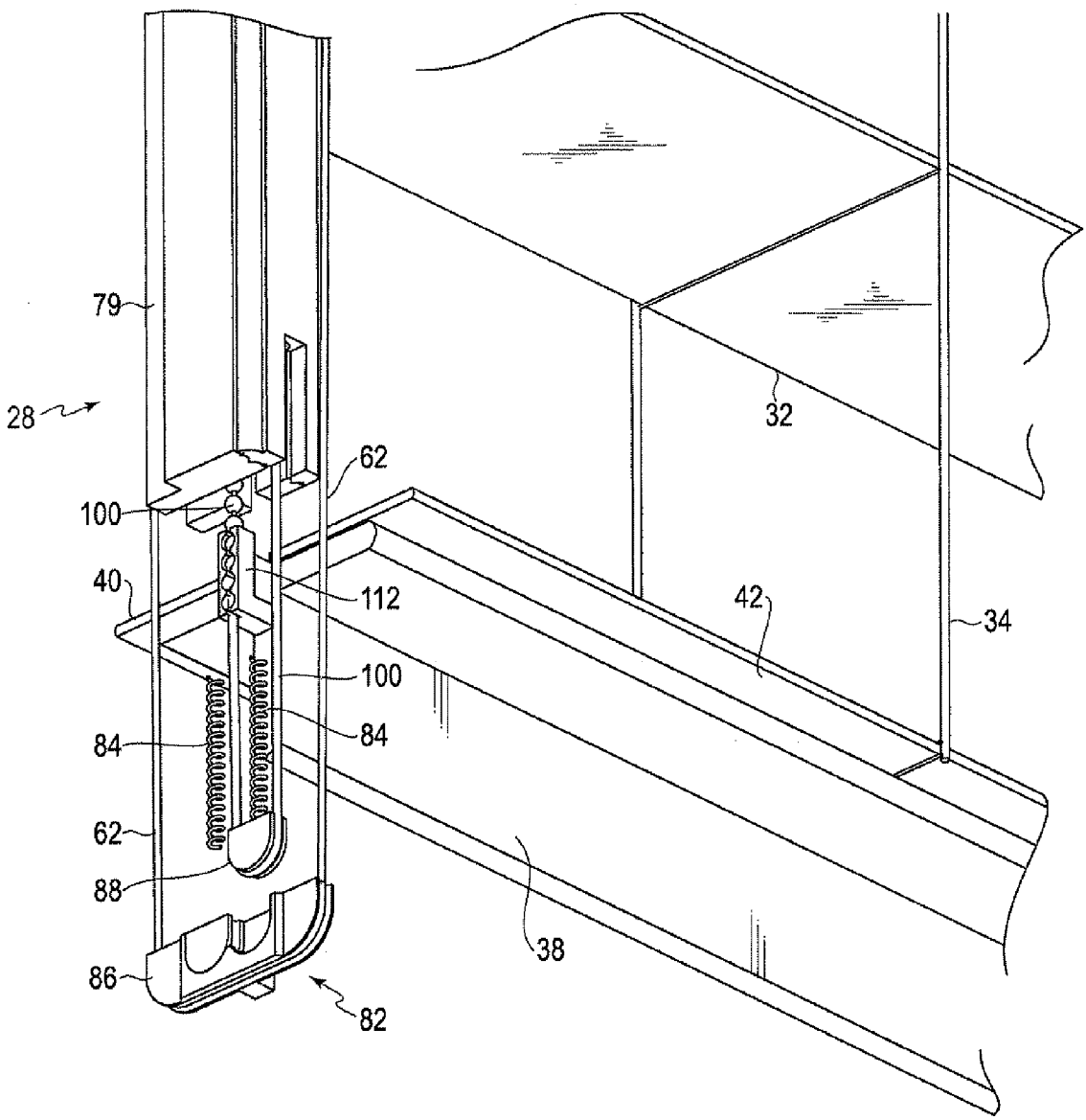
FIG. 12 illustrates an exemplary exploded view of the lower portion of the blind system of FIG. 1.
Figure 13:
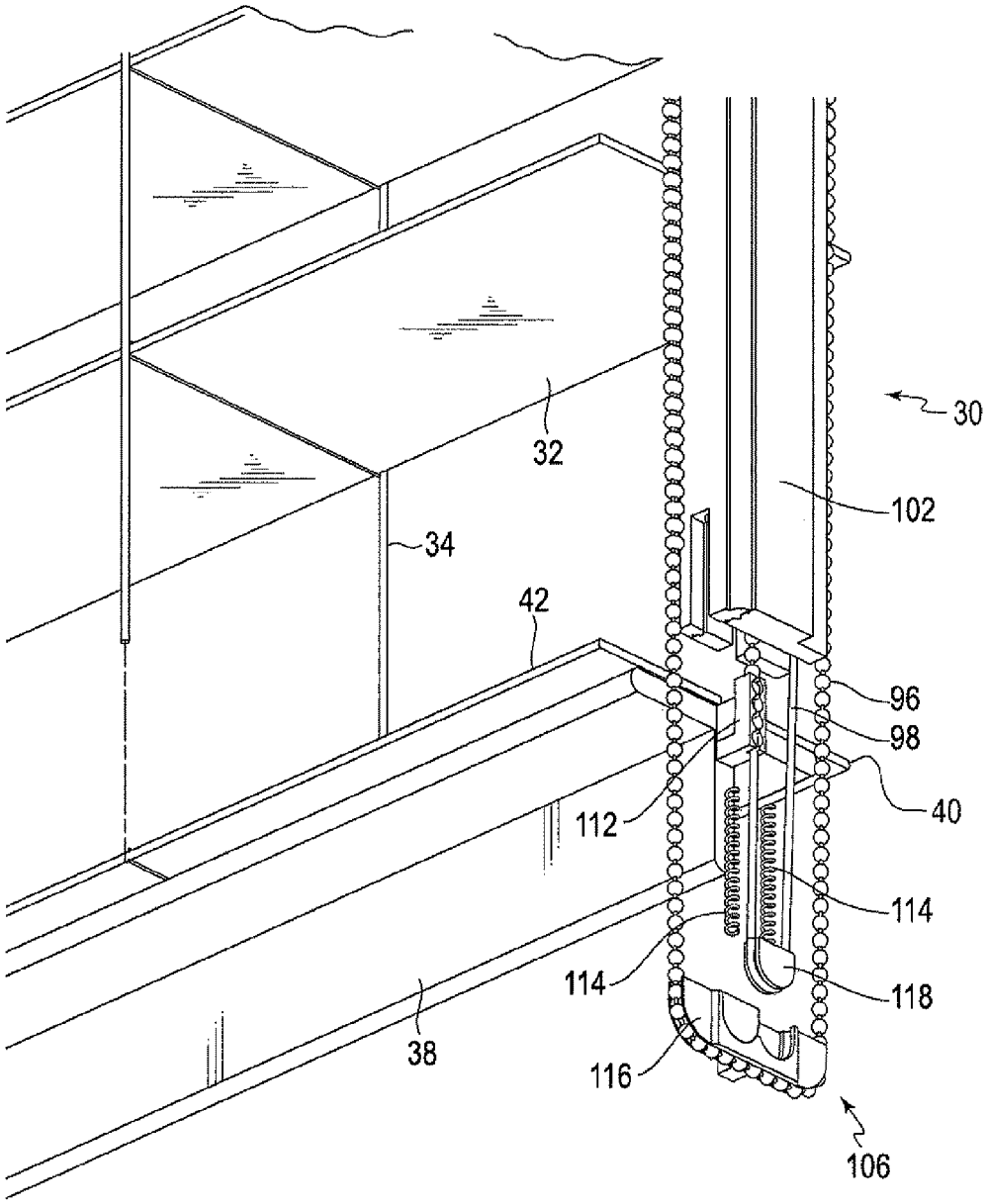
FIG. 13 illustrates another exemplary exploded view of the lower portion of the blind system of FIG. 1.

FIGS. 7-9 show particular details of a preferred embodiment of the tilt rail module 26. The tilt rail module 26 may include a tilt rail 44 that provides support for the plurality of slats 32 and facilitates the tilting of the plurality of slats 32. It is contemplated that the plurality of slats 32 may be suspended from the tilt rail 44 via the connecting member 34. In such a configuration, the rotational movement of the tilt rail 44 may be translated to the plurality of slats 32 via the connecting member 34. For example, tilting the tilt rail 44 in a first direction lowers one portion of the connecting member 34 and raises another portion of the connecting member 34. This causes each of the plurality of slats 32 to tilt in the same direction as the tilt rail 44.

The tilt rail 44 may span the entire width of the blind system 22 and may include a base member 46 from which the connecting member 34 and the plurality of slats 32 are suspended. The base member 46 may be in the shape of a venetian blind slat. Because the tilt rail 44 may span the entire width of the blind system 22 and may provide support for the connecting member 34 and the plurality of slats 32, the tilt rail 44 may be prone to sagging when a width of the window opening 10 is large (e.g., greater than six feet). If permitted to sag, the tilt rail 44 may not function properly. For example, the tilt rail 44 might not provide substantially consistent support for the slats 32. Thus, the slats 32 might become skewed and might permit undesired light to pass through or might not move up or down properly. To counter the potential sag, the tilt rail 44 may include a reinforcing member 48 that extends along the length of the base member 46 and acts as a brace for the tilt rail 44.

The base member 46 and the reinforcing member 48 may be formed from a single element or from two separate elements. In addition, the base member 46 and the reinforcing member 48 may be any shape capable of supporting the plurality of slats 32 and facilitating a rotation of the plurality of slats 32. For example, the base member 46 and the reinforcing member 48 may be curved or planar. In addition, the base member 46 and the reinforcing member 48 may have a triangular shape, a circular shape or any other shape capable of providing support to the tilt rail 44. Also, the base member 46 and the reinforcing member 48 may be combined to form a cross-sectional T-shape or any other cross-sectional shape.

The tilt rail 44 may also include a tension member 50 that may be attached to and may span the length of the reinforcing member 48. The tension member 50 may be attached to only the ends of the reinforcing member 48 via mechanical fasteners, welding or any other securing device. Alternatively, the tension member may be attached to the entire length or a portion of the length of the reinforcing member 48 via mechanical fasteners, welding or any other securing device.

The tension member 50 may provide additional support to prevent the tilt rail 44 from sagging. In one configuration, the tension member 50 may be bowed so that the ends of the tension member 50 may be higher than a central portion of the tension member 50. In this configuration, a biasing force may be maintained in the central portion of the tension member 50 that may act against the force of gravity and may reduce or prevent sagging. It is contemplated that the tension member 50 may be omitted for spans in which the reinforcing member 48 alone may provide enough support to prevent the tilt rail 44 from sagging. The tension member may be installed in any other manner, so as to provide structural support to the tilt rail 44.

In one preferred embodiment, the tilt rail module 26 may also include a timing shaft 52 attached to and running along the length of an underside of the base member 46. The timing shaft 52 may be secured to the tilt rail 44 by a plurality of securing devices 54. Securing devices 54 may be any device that may secure the timing shaft 52 to the base member 46 while permitting the timing shaft 52 to freely rotate independently of the tilt rail 44. In addition, the timing shaft 52 may provide connections between the tilt rail module 26 and the left side frame module 28 and between the tilt rail module 26 and the right side frame module 30.

The base member 46, reinforcing member 48 and tension member 50 may have any sized width such as, for example, greater than four inches. In addition, the lengths of the base member 46, reinforcing member 48 and tension member 50 may be any size such as, for example, four feet or greater.

The tilt rail module 26, left side frame module 28 and right side frame module 30 may be combined to form a frame that may enclose the slat/lift-rail module 24. The blind system 22 may be attached to the window frame 14 via the left and right side frame modules 28 and 30.

In another preferred embodiment, the slat/lift-rail module 24 may include the tilt rail 44. In this embodiment, the slat/lift-rail module 24 may act as a lower frame for the blind system 22.

FIGS. 7-13 show details of a preferred embodiment the left frame module 28 and the right side frame module 30. The left and right side frame modules 28 and 30 include similar components. However, the left side frame module 28 may house a tilting mechanism 56 that may facilitate tilting the tilt rail 44 and the plurality of slats 32, in which case the left side frame module 28 would be a tilt side frame module. Similarly, a lifting mechanism 58 may be primarily housed in the right side frame module 30, in which case the right module would be a lift side frame module, while some of the lifting mechanism 58 may also be included in the left side frame module 28. The lifting mechanism 58 would be configured so as to facilitate raising and lowering the lift rail 38 and the plurality of slats 32 through actuation of the lift module by a user. By way of a mechanical connection, described in greater detail below, the mechanical actuation of the lift side frame module also actuates the part of the lifting mechanism 58 that may be included in the tilt side frame module. It should be understood that, although the left side frame module 28 is shown as housing the tilting mechanism 56, the right side frame module 30 may be configured to house the tilting mechanism 56 instead.

The tilting mechanism 56 may include a tilting sprocket 60 and a tilting chain 62. The tilting chain 62 may be wrapped around a portion of the tilting sprocket 60 so that pulling a portion of the tilting chain 62 causes the tilting sprocket 60 to rotate. It is contemplated that the tilting chain 62 may be substituted with a rope or any other element that may be wrapped around a portion of the tilting sprocket 60 and may cause the tilting sprocket 60 to rotate. In addition, the tilting sprocket 60 may be rotatably mounted on a first bushing 64 that is fixed to a first support bracket 66 secured to a top portion of the left side frame module 28. Also, the tilting sprocket 60 may be secured to the reinforcing member 48 of the tilt rail 44 via a securing member 68 so that a rotation of the tilting sprocket 60 is translated to a rotation of the tilt rail 44. The securing member 68 may be, for example, a nail, a screw, a bolt, or any other fastening device.

The tilt rail 44 may also be rotatably connected to the first bushing 64 via a first cap 70 mounted on the underside of the base member 46. The tilt rail 44 may be rotatably connected to a second bushing 72 via a second cap 74 mounted on the underside of the base member 46. The first and second bushings 64 and 72 may act as supporting members that may support the base member 46 in both a vertical and horizontal direction via the first and second caps 70 and 74. In addition, the second bushing 72 may be fixed to a second support bracket 76 that is secured to a top portion of the right side frame module 30. A first spindle 77 and a second spindle 78 may be at least partially housed within the first and second caps 70 and 74, respectively. The first spindle 77 and the second spindle 78 may be sized and shaped to rotate independently of the tilt rail 44 and the tilting sprocket 60.

In addition to the tilting mechanism 56, the left side frame module 28 may include a frame 79 that may provide structural support for the tilting mechanism 56 and a portion of the lifting mechanism 58. A guide 81 may be secured around the tilting sprocket 60 and the second subordinate lifting sprocket 94 to form one or more guides to prevent the tilting chain 62 and the second subordinate lifting chain 100 from separating from the tilting sprocket 60 and the second subordinate lifting sprocket 94, respectively. The frame 79 may also provide support for the blind system 22 and may be the platform by which the blind system 22 may be attached to the window frame 14 or wall 12. The frame 79 may include a slat guide channel 80 and may house a spring-biasing mechanism 82.

The slat guide channel 80 may receive the projections 36 of the slats 32 and may restrict the movement of the slats 32. For example, the slat guide channel 80 may only permit movement of the slats 32 in the vertical direction and may substantially prohibit movement of the slats 32 in the lateral direction.

The spring-biasing mechanism 82 may maintain tension in the tilting chain 62 when the tilting chain 62 is not being used. Such tension prevents or substantially reduces undesired slack in the tilting chain 62. The spring-biasing mechanism 82 may also be self-adjusting so as to provide slack if the tilting chain 62 is pulled too hard, thereby preventing or substantially limiting damage. The spring-biasing mechanism 82 may include two springs 84, a tilt guide member 86 and a lift guide member 88. The lift guide member 88 may be associated with the lifting mechanism 58 and will be discussed in greater detail in relation to the discussion of the lifting mechanism 58. The tilt guide member 86 may include a channel around which the tilting chain 62 is wrapped. In other words, the tilting chain 62 may form a closed-loop that wraps around the tilting sprocket 60 on one end and the tilt guide member 86 on the other end. The springs 84 may be positioned so as to apply a biasing force that pushes the tilt guide member 86 in a direction away from the tilting sprocket 60, thereby maintaining tension in the tilting chain 62.

When tilting the slats 32, the tilting chain 62 may be pulled. This causes the closed loop formed by the tilting chain 62 to rotate. The rotation of the closed loop would thereby cause the tilting sprocket 60 to also rotate, which may be translated to the tilt rail 44 via the securing member 68. In addition, the rotational movement of the tilt rail 44 may cause the connecting member 34 to move, thereby causing the plurality of slats 32 and one of the sub-slats 40 and 42 to rotate to a tilted position.

The lifting mechanism 58 may include a primary lifting sprocket 90, a first subordinate lifting sprocket 92 and a second subordinate lifting sprocket 94. A primary lifting chain 96 may be wrapped around a portion of the primary lifting sprocket 90 so that pulling a portion of the primary lifting chain 96 causes the primary lifting sprocket 90 to rotate. A first subordinate lifting chain 98 may be wrapped around a portion of the first subordinate lifting sprocket 92 so that a rotational movement of the first subordinate lifting sprocket 92 causes a closed loop chain formed by the first subordinate lifting chain 98 to rotate. In addition, a second subordinate lifting chain 100 may be wrapped around a portion of the second subordinate lifting sprocket 94 so that a rotational movement of the second subordinate lifting sprocket 94 causes a closed loop chain formed by the second subordinate lifting chain 100 to rotate. Similar to the tilting chain 62, it is contemplated that the primary lifting chain 96, first subordinate lifting chain 98 and second subordinate lifting chain 100 may be substituted with a rope or any other similar element.

The primary lifting sprocket 90 and the first subordinate lifting sprocket 92 may be rotatably mounted on the second bushing 72 that may be fixed to the second support bracket 76. In addition, the first subordinate lifting sprocket 92 may be fixedly mounted onto the primary lifting sprocket 90 so that a rotational movement of the primary lifting sprocket 90 may be translated to a rotational movement of the first subordinate lifting sprocket 92. Also, the primary lifting sprocket 90 and the first subordinate lifting sprocket 92 may receive the second spindle 78 so that the rotational movement of the primary lifting sprocket 90 and the first subordinate lifting sprocket 92 may be translated to a rotational movement of the second spindle 78.

The second spindle 78 may receive the timing shaft 52 so that the rotational movement of the second spindle 78 may be translated to a rotational movement of the timing shaft 52. The cross-sectional shape of the timing shaft 52 may be selected for ease of installation while facilitating the transfer of rotational movement. For example, the cross-sectional shape of the timing shaft 52 and the second spindle 78 may be a hexagonal shape. The first spindle 77 may have the same cross-sectional shape as the timing shaft 52 so that the rotational movement of the timing shaft 52 may be translated to a rotational movement of the first spindle 77. In addition, the first spindle 77 may be connected to the second subordinate lifting sprocket 94 so that the rotational movement of the first spindle 77 may be translated to a rotational movement of the second subordinate lifting sprocket 94. It should be understood that the rotational movement of the first spindle 77 may not be translated to a rotational movement of the tilting sprocket 60. However, the rotational movement of the second subordinate lifting sprocket 94 may be translated to a rotational movement of a closed-loop chain formed by the second subordinate lifting chain 100.

Similar to the left side frame module 28, the right side frame module 30 may include a frame 102 that provides structural support for the lifting mechanism 58. A guide 103 may be secured around the primary lifting sprocket 90 and the first subordinate lifting sprocket 92 to form one or more guides to prevent the primary lifting chain 96 and the first subordinate lifting chain 98 from separating from the primary lifting sprocket 90 and the first subordinate lifting sprocket 92, respectively. The frame 102 may also provide support for the blind system 22 and may be the platform by which the blind system 22 may be attached to the window frame 14 or wall 12. The frame 102 may include a slat guide channel 104 and may house a spring-biasing mechanism 106. The frame 102, slat guide channel 104 and spring-biasing mechanism 106 may be similar to the frame 79, the slat guide channel 80 and the spring-biasing mechanism 82, respectively. Similar to the spring-biasing member 82, the spring-biasing mechanism 106 may include two springs 114 (similar to the springs 84), a primary lift guide member 116 (similar to the tilt guide member 86) and a subordinate lift guide member 118 (similar to the lift guide member 88).

The frames 79 and 102 may include a first subordinate lift chain tunnel 108 and a second subordinate lift chain tunnel 110, respectively. The first subordinate lift chain tunnel 108 may form a conduit through which the first subordinate lifting chain 98 may be situated. In other words, the closed-loop chain formed by the first subordinate lifting chain 98 may be wrapped around the first subordinate lifting sprocket 92 and the subordinate lift guide member 118. In addition, the second subordinate lift chain tunnel 110 may form a conduit through which the second subordinate lifting chain 100 may be situated. In other words, the closed-loop chain formed by the second subordinate lifting chain 100 may be wrapped around the second subordinate lifting sprocket 94 and the lift guide member 88.

The lifting mechanism 58 also includes support members 112 that may be secured to the first and second subordinate lifting chains 98 and 100, respectively. The support members 112 may support the lift rail 38 at each end of the lift rail 38. Accordingly, the rotational movements of the first and second subordinate lifting chains 98 and 100 may cause the support members 112 to move up or down, thereby moving the lift rail 38 up or down.

To improve ease of installation, the components of the blind system 22 may be combined into sub-modular components. For example, the tilting sprocket 60, second subordinate lifting sprocket 94, first bushing 64, first support bracket 66 and first spindle 77 may be combined into a sub-modular component, which may be manufactured and assembled in advance to conform with predetermined lengths that may correspond to inner dimensions of window opening 10 or common inner dimensions of common window sizes. In addition, the primary lifting sprocket 90, first subordinate lifting sprocket 92, second bushing 72, second support bracket 76 and second spindle 78 may be combined into a second sub-modular component. Creating the sub-modular components may reduce the number of separate components needed to assemble the blind system 22, thereby reducing installation time and labor costs.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. A tilt rail assembly for a venetian blind, the tilt rail assembly comprising:

a tilt rail comprising a base member in the shape of a venetian blind slat and having a first end and a second end and two edges extending longitudinally between said first end and said second end;

a pair of support members, each support member configured to vertically and horizontally support the base member at one of the first and second ends while permitting pivoting of the base member along a longitudinal tilt axis of the base member; and a reinforcing member attached to a surface of and extending along a length of the base member between said edges and having a first end and a second end, the reinforcing member being configured to restrict or prevent sagging of the base member.

2. The tilt rail assembly of claim 1, further comprising a tensioning member extending between the first and second ends of the reinforcing member, the tensioning member being configured to apply a tensioning force along the reinforcing member that further restricts or prevents sagging of the reinforcing member and base member.

3. The tilt rail assembly of claim 1, wherein the combination of the base member and reinforcing member has an inverted T-shaped cross-section in which the reinforcing member is orthogonally disposed relative to the base member along the tilt axis of the base member.

4. The tilt rail assembly of claim 1, wherein the base member has a curved cross-section.

5. The tilt rail assembly of claim 1, further comprising a support rod extending between and beyond said support members on which said base member may be pivotably supported by way of said support members.

6. The tilt rail assembly of claim 1, wherein the base member has a width that is equal to or greater than 3 inches.

7. The tilt rail assembly of claim 6, wherein the base member has a width that is equal to or greater than 4 inches.

8. The tilt rail assembly of claim 7, wherein the base member has a width that is equal to or greater than 5 inches.

9. The tilt rail assembly of claim 1, wherein the base member has a length equal to or greater than 6 feet.

10. The tilt rail assembly of claim 9, wherein the base member has a length equal to or greater than 8 feet.

11. The tilt rail assembly of claim 10, wherein the base member has a length equal to or greater than 10 feet.

12. The tilt rail assembly of claim 2, wherein the reinforcing member is attached to the tensioning member along an entire length of the tensioning member.

13. A venetian blind comprising a plurality of slats operatively connected to the tilt rail of the tilt rail assembly of claim 1 such that tilting of the base member around the longitudinal axis causes tilting of the slats.

14. The venetian blind of claim 13, wherein the base member has a length equal to or greater than 6 feet, and the base member is supported in the vertical direction at only the first and second ends of the base member.

15. The venetian blind of claim 13, further comprising a tensioning member extending between the first and second ends of the reinforcing member, the tensioning member being configured to apply a tensioning force along the reinforcing member that further restricts or prevents sagging of the reinforcing member and base member.

16. The venetian blind of claim 15, wherein the reinforcing member is attached to the tensioning member along an entire length of the tensioning member.

17. A venetian blind comprising a plurality of slats having a slat width, and a divided slat assembly that comprises:

a first and second sub-slat, each sub-slat having a width that is approximately half the slat width;

the first and second sub-slats being pivotably connected to each other along a length of the first and second sub-slats;

wherein the slats and the divided slat assembly are configured such that when the slats tilt from a horizontal position towards a first direction, the first sub-slat tilts with the slats while the second sub-slat remains in the horizontal position, and when the slats tilt from the horizontal position in a direction opposite to the first direction, the first sub-slat remains in the horizontal position while the second sub-slat tilts with the slats.

18. The venetian blind of claim 17, further comprising a lift rail configured to lower and raise the first and second sub-slats and the plurality of slats.

19. The venetian blind of claim 18, wherein sub-slats are configured to lie substantially flat on the lift rail when the slats are in the horizontal position.

20. The venetian blind of claim 18, further comprising a tilt rail assembly comprising:

a base member in the shape of a venetian blind slat and having a first end and a second end;

a pair of support members, each support member configured to vertically and horizontally support the base member at one of the first and second ends; and a reinforcing member extending along a length of the base member and having a first end and a second end, the reinforcing member being configured to restrict or prevent sagging of the base member.

21. The venetian blind of claim 20, further comprising a tensioning member extending between the first and second ends of the reinforcing member, the tensioning member being configured to apply a tensioning force along the reinforcing member that further restricts or prevents sagging of the reinforcing member and base member.

22. The venetian blind of claim 20, further including a first side frame positioned at a first end of the plurality of slats and a second side frame positioned at a second end of the plurality of slats.

23. The venetian blind of claim 22, wherein the first side frame includes a tilt member fixedly connected to at least one of the base member and the reinforcing member and positioned to be rotatable.

24. The venetian blind of claim 23, wherein at least the second side frame includes a lift assembly comprising:

a rotatable lift sprocket;

a flexible member wrapped around a portion of a circumferential edge of the lift sprocket; and a support member secured to the flexible member and configured to support an end of the lift rail.

25. The venetian blind of claim 24, wherein the first side frame and the second side frame each includes a said lift assembly.

26. A modular venetian blind system, comprising:

a tilt-rail module that includes a tilt rail operatively connectable to a set of tiltable slats;

a first side frame module;

a second side frame module; and a slat/lift-rail module that includes a lift rail, and the set of tiltable slats operatively connected to the lift rail and operatively connectable to the tilt-rail;

wherein:

at least one of the first and second side frame modules includes and supports a tilt mechanism mounted on said at least one of the side frame modules and configured to tilt the tilt rail and thereby tilt any slats that are operatively connected to the tilt rail; and the first and second side frame modules each include and support a lift mechanism mounted on the respective side frame module and configured to raise and lower the lift rail and thereby raise and lower the operatively connected slats.

27. The modular venetian blind system of claim 26, wherein:

the tilt rail comprises a base member in the shape of a slat and having a first end and a second end, and a reinforcing member extending along a length of the base member and having a first end and a second end, the reinforcing member being configured to restrict or prevent sagging of the base member.

28. The modular venetian blind system of claim 27, further comprising a tensioning member extending between the first and second ends of the reinforcing member, the tensioning member being configured to apply a tensioning force along the reinforcing member that further restricts or prevents sagging of the reinforcing member and base member.

29. The modular venetian blind system of claim 26, wherein the tiltable slats are suspended from the tilt rail by at least one connecting member, the slats defining a slat width, and a lowermost slat of said slats comprises a first and second sub-slat, each sub-slat having a width that is approximately half the slat width;

the first and second sub-slats being pivotably connected to each other along a length of the first and second sub-slats;

wherein the first and second sub-slats are configured such that when the tiltable slats are tilted from a horizontal position towards a first direction, the first sub-slat tilts while the second sub-slat remains in the horizontal position, and when the tiltable slats are tilted from the horizontal position in a direction opposite to the first direction, the first sub-slat remains in the horizontal position while the second sub-slat tilts.

30. The modular venetian blind system of claim 26, wherein the lift assembly on one side frame module is mechanically actuable by the lift assembly on the other side frame module.

31. The modular venetian blind system of claim 30, wherein the tilt assembly and the lift assembly that are on the same side module share a prefabricated subassembly.

32. The modular venetian blind assembly of claim 26, wherein the tilt mechanism comprises a sprocket rotatably mounted on said at least one of the side frame modules.

* * * * *